US008789276B2

(12) United States Patent
Thomas

(10) Patent No.: US 8,789,276 B2
(45) Date of Patent: Jul. 29, 2014

(54) SANITARY FIXTURE

(71) Applicant: Grohe AG, Hemer (DE)

(72) Inventor: Karl Thomas, Menden (DE)

(73) Assignee: Grohe AG, Hemer (DE)

( * ) Notice: Subject to any disclaimer, the term of this patent is extended or adjusted under 35 U.S.C. 154(b) by 0 days.

(21) Appl. No.: 13/747,006

(22) Filed: Jan. 22, 2013

(65) Prior Publication Data

US 2013/0133753 A1 May 30, 2013

Related U.S. Application Data

(63) Continuation of application No. PCT/EP2011/003671, filed on Jul. 22, 2011.

(30) Foreign Application Priority Data

Jul. 28, 2010 (EP) ..... EP10007834

(51) Int. Cl.

| | |
|---|---|
| ***B21D 51/16*** | (2006.01) |
| ***B21K 1/76*** | (2006.01) |
| ***B23P 17/00*** | (2006.01) |
| ***B21D 39/02*** | (2006.01) |
| ***E03C 1/04*** | (2006.01) |
| *B23P 19/04* | (2006.01) |

(52) U.S. Cl.

CPC ..... *E03C 1/0404* (2013.01); *E03C 1/04* (2013.01)

USPC ..... 29/890.141; 29/460; 29/463; 4/678

(58) Field of Classification Search

CPC ..... E03C 1/04; B21D 51/18; B21D 51/42; B23P 11/00

USPC ..... 29/458, 459, 460, 463, 890.14, 29/890.141; 4/678

See application file for complete search history.

(56) References Cited

U.S. PATENT DOCUMENTS

| | | | | |
|---|---|---|---|---|
| 877,322 | A * | 1/1908 | Gebler | 222/566 |
| 2,795,844 | A * | 6/1957 | Liszak | 29/458 |

(Continued)

FOREIGN PATENT DOCUMENTS

| | | | |
|---|---|---|---|
| DE | 1 777 174 | A1 | 7/1971 |
| DE | 44 38 647 | A1 | 5/1996 |
| EP | 0 452 699 | A1 | 10/1991 |

OTHER PUBLICATIONS

ASM International Handbook Committee (1993). ASM Handbook, vol. 06-Welding, Brazing, and Soldering. ASM International. Online version available at: http://app.knovel.com/hotlink/toc/id:kpASMHVWB1/asm-handbook-volume-06.*

*Primary Examiner* — David Bryant
*Assistant Examiner* — Jason L Vaughan
(74) *Attorney, Agent, or Firm* — Muncy, Geissler, Olds & Lowe, P.C.

(57) ABSTRACT

The invention relates to a sanitary fitting having a housing element and a functional unit which comprises water-conducting components and is housed in the housing body of the sanitary fitting, wherein the housing element comprises at least two shell-shaped individual parts. The shell-shaped individual parts are produced from a metal alloy or a plastic in a diecasting process and are adhesively bonded to each other or connected to each other by means of material bonding to form a hollow element surrounding the functional unit by means of a joining process.

7 Claims, 3 Drawing Sheets

(56) References Cited

U.S. PATENT DOCUMENTS

| | | | | |
|---|---|---|---|---|
| 3,893,601 | A * | 7/1975 | Winslow | 222/566 |
| 3,939,550 | A * | 2/1976 | Winslow | 29/458 |
| 4,649,958 | A * | 3/1987 | Purcell | 137/801 |
| 5,006,207 | A * | 4/1991 | Peterman et al. | 205/120 |
| 5,165,121 | A * | 11/1992 | McTargett et al. | 4/678 |
| 5,579,823 | A * | 12/1996 | Mikol et al. | 164/98 |
| 5,924,451 | A | 7/1999 | Kuo | |
| 6,082,407 | A * | 7/2000 | Paterson et al. | 137/801 |
| 6,170,098 | B1 * | 1/2001 | Pitsch | 4/678 |
| 6,189,569 | B1 | 2/2001 | Calhoun | |
| 6,202,980 | B1 * | 3/2001 | Vincent et al. | 251/129.04 |
| 6,817,379 | B2 * | 11/2004 | Perla | 137/801 |
| 7,717,133 | B2 * | 5/2010 | Pinette et al. | 137/801 |
| 7,766,043 | B2 * | 8/2010 | Thomas et al. | 137/801 |
| 8,046,850 | B2 * | 11/2011 | Chang | 4/675 |
| 8,156,963 | B2 * | 4/2012 | Lopp et al. | 137/801 |
| 8,365,770 | B2 * | 2/2013 | Thomas et al. | 137/625.4 |
| 8,439,074 | B2 * | 5/2013 | Farag | 137/801 |
| 2007/0119506 | A1 | 5/2007 | Giagni, Jr. et al. | |
| 2009/0260153 | A1 | 10/2009 | Thomas | |

* cited by examiner

SANITARY FIXTURE

This nonprovisional application is a continuation of International Application No. PCT/EP2011/003671, which was filed on Jul. 22, 2011, and which claims priority to European Patent Application No. EP 10007834.4, which was filed in Europe on Jul. 28, 2010, and which are both herein incorporated by reference.

BACKGROUND OF THE INVENTION

1. Field of the Invention

The invention relates to sanitary fixtures.

2. Description of the Background Art

Fitting bodies for sanitary fixtures are usually cast in brass. The exterior of the body later forms the decorative surface and the interior of the body forms the water conduits. Before they can be provided with a coating or chromium-plated, they have to be ground and polished after casting in order to receive a suitable surface for an electroplating process.

From U.S. Pat. No. 6,189,569 B1 sanitary fixtures are known, which have a base plate and a visible housing, which are connected to one another by means of a locking connection and which has a water conduit that is inserted as a unit into the visible housing.

US 2007/0119506 A1 shows a sanitary fixture in so-called chassis construction, in which the water conduit as a sealed assembly is inserted into a fitting housing assembled by means of a locking or clip connation, which is composed of two virtually symmetrical housing halves.

Furthermore, a sanitary fixture is known from DE 44 38 647 A1, which is produced from sheet metal parts or of two sheet metal half shells, which are connected to one another at their edges.

SUMMARY OF THE INVENTION

It is therefore an object of the invention to improve a sanitary fixture with a decorative housing and a separate water conduit.

Within an embodiment of the invention, a sanitary fixture with a housing body and a functional unit are provided, which comprises all water-carrying parts and which is accommodated in the housing body of the sanitary fixture. The housing body can be understood to mean a decorative housing that does not have any contact with drinking water. Contact with drinking water is produced via the functional unit, which can comprise connections to the supply terminals, the water conduits, channels for cold water, hot water and/or mixed water, mixing valves and/or foamers, etc.

The housing body thereby can include at least two shell-shaped single parts that are made of a metallic alloy in the die-casting process or of a suitable plastic. Zinc die-cast alloys and aluminum die-cast alloys as well as a plurality of suitable plastics are conceivable hereby.

In contrast to the gravity/low-pressure brass casting method, it is possible by means of die-casting methods or plastic spray processes, which is also a die-casting method, to cast very clean molds, edges and contours, so that the expenditure for reworking the cast parts or plastic parts is considerably reduced. It is likewise possible hereby to cast in parts of different materials, such as bushings, stud bolts or the like. For the sanitary fixture according to the invention, the shell-shaped single parts are connected to one another adhesively or by material bonding to form a hollow body surrounding the functional unit by means of a joining process.

Advantageously, the shell-shaped single parts are made of an aluminum cast alloy, preferably from the group of AlSi10Mg (Fe), AlSi12(Fe), AlSi9Cu3(Fe) or AlSi12Cu1 (Fe). Aluminum die-cast alloys of this type have a very high contour precision after removal from the casting mold. Furthermore, these alloys have a very good machinability and a very good chemical resistance. Zinc die-cast alloys as well as plastics are also very suitable for the production of precise single parts.

The wall thicknesses of shell-shaped single parts of this type can be approx. 0.8 mm to 2 mm. Preferably, by means of die-casting methods wall thickness of 1 mm with zinc die-casting methods, 1.4 mm with aluminum die-casting methods and 2 mm with plastic spray processes can be realized. The material requirement for the production of the housing is thereby reduced to a minimum in contrast to conventional casting methods.

The achievable tolerances can be ±0.05 mm to ±0.15 mm, so that this is also referred to as a finished casting.

According to an embodiment of the invention, the housing is provided of two symmetrical shell-shaped single parts. Depending on the outer geometry of the housing body, however, a body of a plurality of parts is also conceivable. The separation seams between the single parts do not have to lie in one plane, but can be adapted to the geometry of the outer housing.

With the production of the housing body, the shell-shaped single parts are connected to one another adhesively, adhesively and positively or by material bonding. In addition to known welding or soldering processes, it is possible to glue the shell-shaped single parts to one another.

Advantageously, adhesives based on acrylates and epoxides can be used. The adhesive connections cure very quickly and are very chemical-resistant. Advantageously, the adhesives cure free from gassing. If the sanitary fixture is to be coated after installation of the functional unit into the housing, it must be ensured that with the insertion of the sanitary fixture and the adhered single parts into a vacuum chamber, for example with PVD or CVD processes, no gases escape.

One further development of the invention provides that the shell-shaped single parts have joint edges with profiles. To this end, the joint edges of the shell-shaped single parts can have a lock seam, a groove or a profile corresponding to the groove, a projection or a lug.

Each single part can have a projection on a first joint edge and a recess on a second joint edge such that respectively one joint edge of one single part engages with a projection into a recess of a joint edge of a second single part. To this end, the surfaces of the projections and recesses can have a wedge shape. When the single parts are pushed together, a clamping connection can already be produced thereby, wherein the positioning of the single parts to one another takes place in a very precise manner.

In order to produce the smallest possible separation joint, it is an advantage that the joint edges of the shell-shaped single parts abut one another edge to edge at the outer region of the housing body and have a gap from one another in the inner region of the housing body. To this end the length of the projections in the profiles of the joint edges on the inside is smaller than the length of the corresponding recesses.

Furthermore, it is provided to arrange on the inside of the shell-shaped single parts webs or edges for positioning or fixing the functional unit. Furthermore, positioning devices for fastening elements or fastening elements themselves can be provided on the shell-shaped single parts. With the aid of the fastening elements, after the completion of the sanitary fixture, the housing body is fixed to the surfaces, tubs, vanities etc. provided for this purpose. The webs or edge are already embodied in the die-casting mold, so that a subsequent processing of the single parts for the housing body in the inner region as well as on the surface of the housing body can be largely reduced.

An embodiment of the invention provides that after the connection of the shell-shaped single parts the housing body is provided with a coating. A layer sequence of a primer paint coat, PVD layer and a paint cover layer is provided hereby. The advantage of a coating with the above-referenced layers lies in that they have a certain thickness by means of which it is possible to cover separation joints possibly still visible. This means that after the coating the housing body appears to be a one-piece body. In the assembled state of the completed sanitary fixture, the observer will no longer be able to recognize the multi-part nature of the housing body based on the outer form.

With the invention a method for producing a sanitary fixture with the following steps is also provided. Firstly, at least two shell-shaped single parts with profiled joint edges for a housing body are produced by means of a die-casting method. Subsequently, a functional unit, which comprises all of the water-carrying parts of the sanitary fixture, is inserted into one of the single parts of the housing body. Thereupon the housing body is produced by means of the connection and adhesion of the shell-shaped single parts.

Alternatively thereto, before the production of the housing body, a coating of the single parts can be carried out by means of wet-chemical methods, physical methods or painting methods or a combination of layers according to these methods.

For the connection of the single parts of the housing body it is an advantage if a preparation of the joint edges of the single parts is carried out by mechanical or chemical roughening or is activated by atmospheric plasma on an atomic level. Furthermore, it is important for the desired coating and surface quality that, after the adhesion of the single parts, a reworking of the adhesive joint takes place by means of grinding, brushing or polishing. It is furthermore possible by means of a coating process of a layer sequence of at least one primer or compensation layer, a PVD layer and a cover paint layer, to cover the separation joints between the single parts such that the housing body appears to be one piece.

According to an embodiment, a sanitary fixture with a housing body can be produced, the shell-shaped single parts of which are composed of an aluminum die cast alloy Al Si10Mg(Fe), wherein the chemical composition of the cast alloy is given as a percentage by weight; the mass compositions in parentheses can thereby deviate from the casting compositions: Si 9.0-11.0; Fe 1.0 (0.45-0.9); Cu 0.10 (0.08); Mn 0.55; Mg 0.20-0.50 (0.25-0.50); Ni 0.15; Zn 0.15; Pb 0.15; Sn 0.05; Ti 0.20 (0.15); other 0.15; rest being aluminum.

According to an exemplary embodiment, a sanitary fixture with a housing body can be produced, the shell-shaped single parts of which are composed of an aluminum die-cast alloy AlSi12(Fe), wherein the chemical composition of the cast alloy is given as a percentage by weight; the mass compositions in parentheses can thereby deviate from the casting compositions: Si 10.5-13.5; Fe 1.0 (0.45-0.9); Cu 0.10 (0.08); Mn 0.55; Zn 0.12; Ti 0.15; other 0.25; the rest being aluminum.

According to another exemplary embodiment, a sanitary fixture with a housing body can be produced, the shell-shaped single parts of which are composed of an aluminum die-cast alloy Al Si9Cu3(Fe), where in the chemical composition of the cast alloy is given as a percentage by weight; the mass compositions in parentheses can thereby deviate from the casting compositions: Si 8.0-11.0; Fe 1.3 (0.6-1.1); Cu 2.0-4.0; Mn 0.55, Mg 0.05-0.55 (0.15-0.55); Cr 0.15; Ni 0.55; Zn 0.12; Pb 0.35; Sn 0.25; Ti 0.25 (0.20); other 0.25; the rest being aluminum.

According to an exemplary embodiment, a sanitary fixture with a housing body can be produced, the shell-shaped single parts of which are composed of an aluminum die-cast alloy AlSi12Cu1(Fe), wherein the chemical composition of the cast alloy is given as a percentage by weight; the mass compositions in parentheses can thereby deviate from the casting compositions: Si 10.5-13.5; Fe 1.3 (0.6-1.1); Cu 0.7-1.2; Mn 0.55; Mg 0.35; Cr 0.10; Ni 0.30; Zn 0.55; Pb 0.20; Sn 0.10 (0.15); other 0.25, the rest being aluminum.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
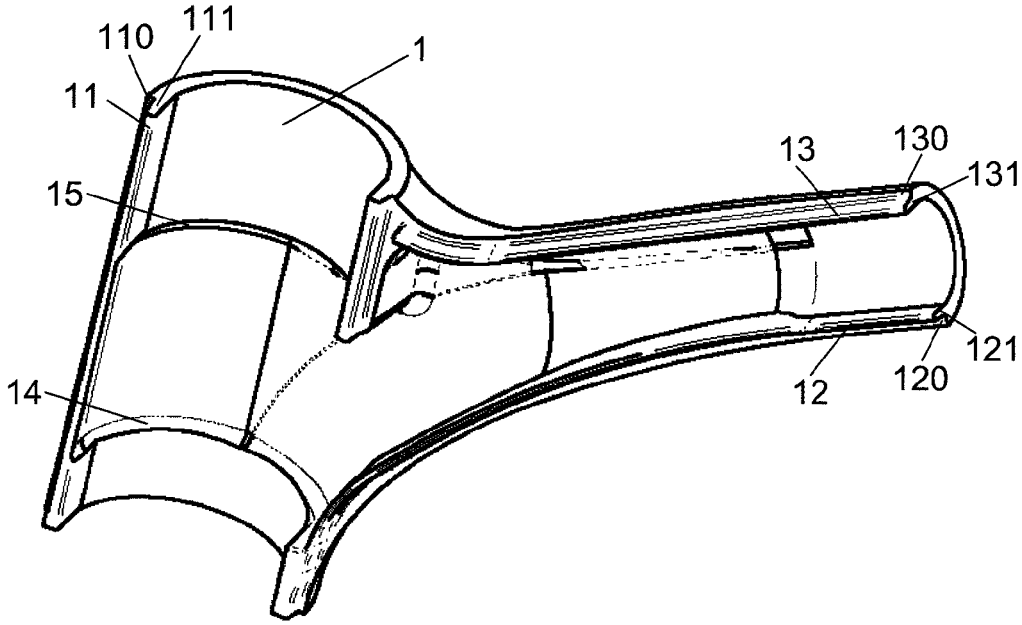
FIG. 1 is a perspective view of a shell-shaped single part for a housing body of a plumbing fixture according to the invention.

FIG. 1 shows a perspective view of a shell-shaped single part 1 for a housing body of a kitchen fixture. The shell-shaped single part 1 is produced in an aluminum die-cast method. It therefore has very small wall thicknesses in the range of 0.8 mm-2.0 mm. This makes it possible to produce a housing body with the lowest material expenditure.

Figure 2:
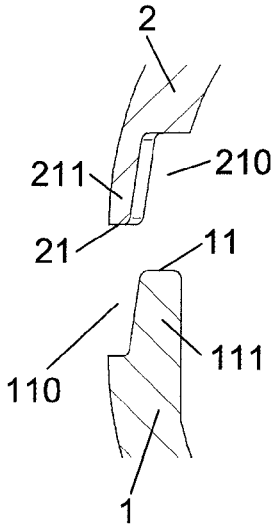
FIG. 2 is a section through profiled joint edges of two single parts in detail.
Figure 3:
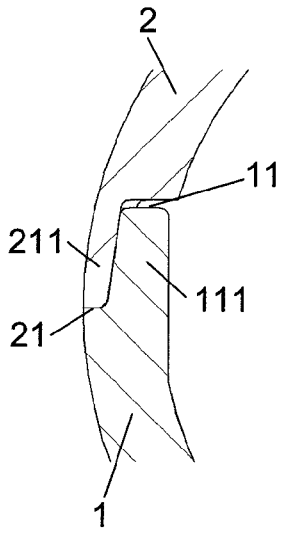
FIG. 3 is a section through profiled joint edges of two single parts in the joined state in detail.

FIGS. 2 and 3 respectively show a detail of a joint edge 11, 21. The profiling of the joint edges 11, 21 is provided in the form of a lock seam. To this end on each joint edge 11, 21 a recess 110, 210 as well as a projection 111, 211 is arranged, wherein the projection 211 of the single part 2 arranged on the outside of the fixture body in the final condition adjoins edge to edge the boundary edge of the recess 110 of the single part 1. It is clear from FIG. 3 that the joint edges 11, 21 of the single parts 1, 2 have a gap in the inner region.

Figure 4:
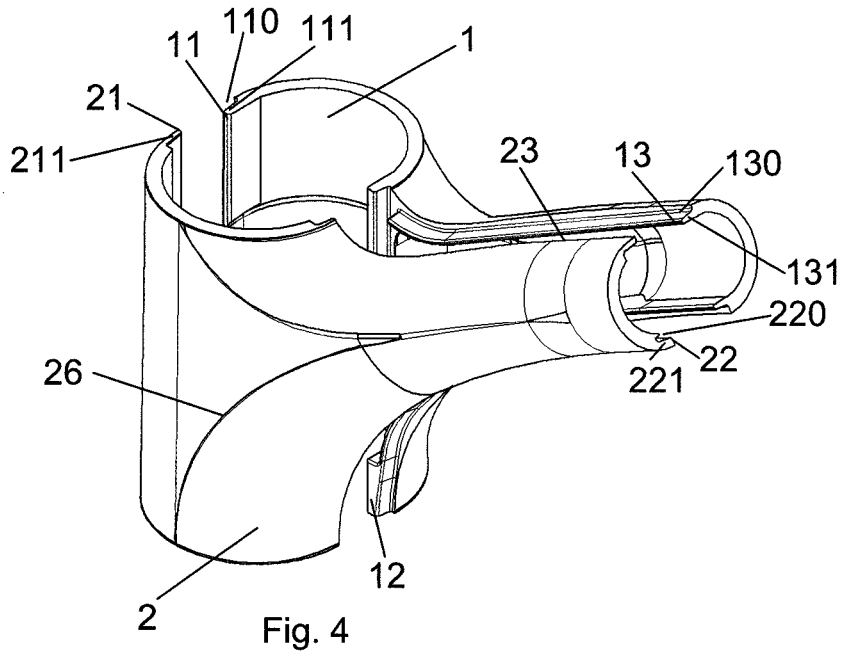
FIG. 4 is a perspective view of two complementary single parts for a housing body of a sanitary fixture according to the invention.

It is clear from FIG. 4 that two shell-shaped single parts 1, 2 are necessary for the fixture body of the provided kitchen fixture, which single parts are connected to one another at their joint edges 11, 12, 13, 21, 22, 23, so that the housing body in all has three separation joints.

Figure 5:
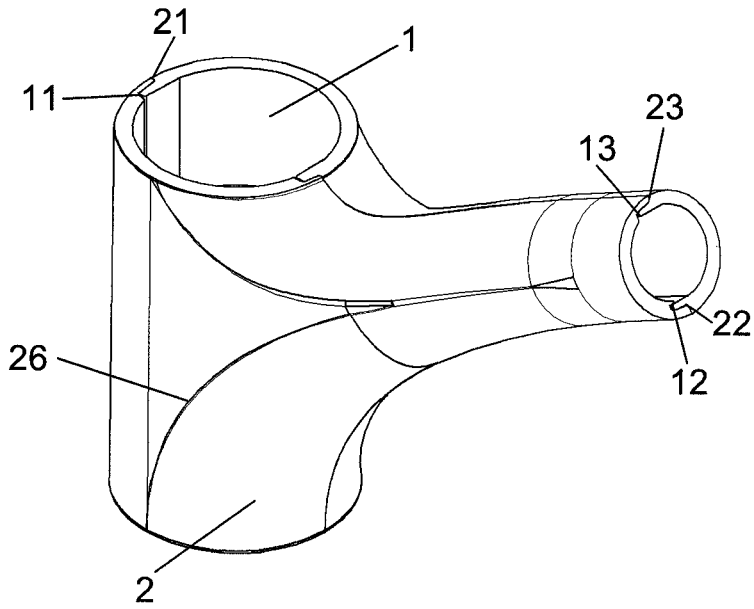
FIG. 5 is a perspective view of a joined housing body.

It is clear from FIG. 5, in which the two single parts 1, 2 are shown joined, that the separation joint of the fixture body runs in the symmetry axis thereof. The single parts 1, 2 thus comprise respectively half of the housing body, in which the mixing cartridge is accommodated, and half of the outlet.

The joint edges 11, 12, 13 of the first single part 1 have a profile with a recess 110, 120, 130, while the joint edges 21, 22, 23 of the second single part 2 have a profile with a projection 211, 221, 231. The respective lengths of the recesses 110, 120, 130 and the projections 211, 221, 231 are measured such that the joint edges 11, 12, 13, 21, 22, 23 of the single parts 1, 2 adjoin one another in the separation joint on the outside of the housing body, while the housing body on the inside has a very small gap in the region of the separation joints.

The die-casting method provides the possibility of influencing even the outer geometry of the fixture housing and the linear guidance 26 for the final geometry of the design. The subsequent processing during grinding and polishing work is thus also considerably reduced.

Figure 6:
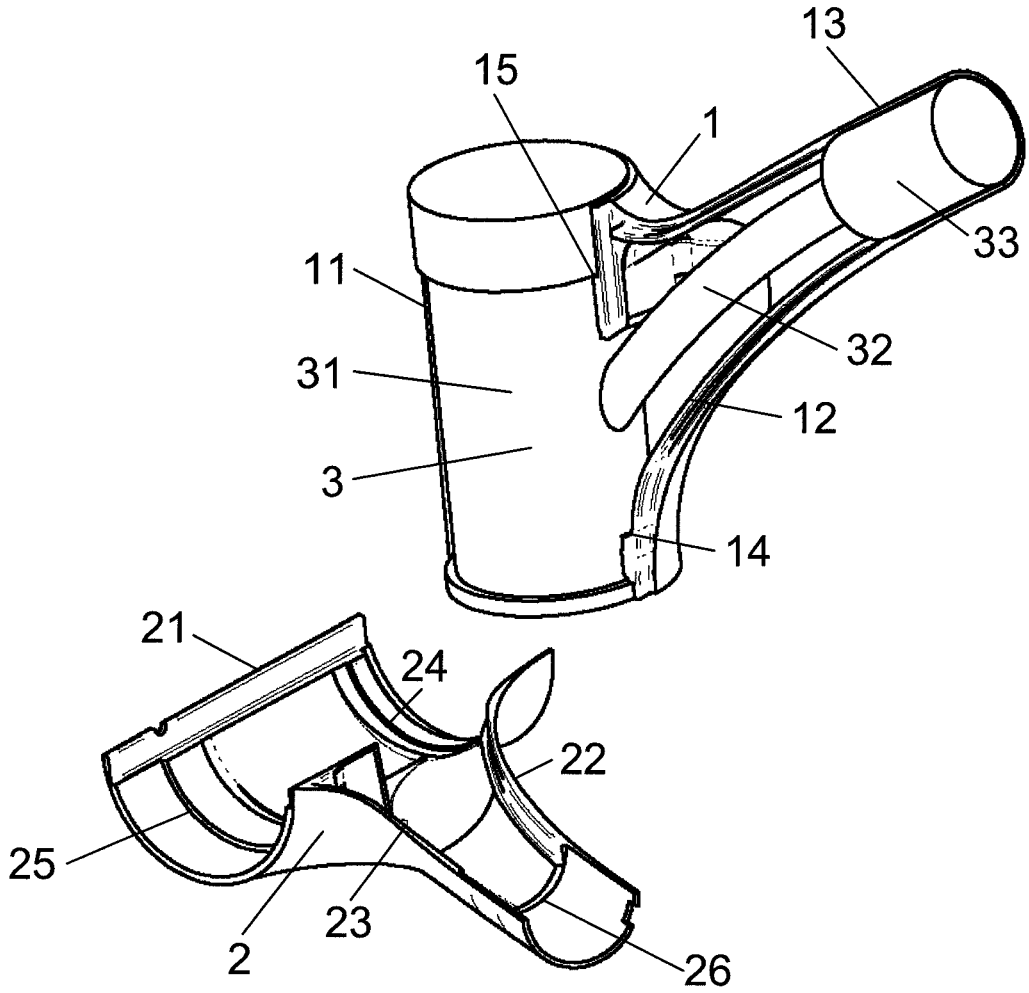
FIG. 6 is a perspective view of a sanitary fixture according to the invention with functional unit before the joining operation.

It is clear from FIG. 6 that the single parts 1, 2 in the inner region have projections 14, 15, 24, 25 which are produced during the casting process and which already establish the final position of a functional unit 3.

The functional unit 3 hereby comprises all of the components that come into contact with drinking water. It can be embodied in a one-piece manner or also be assembled from several individual elements. In the exemplary embodiment shown, the functional unit or water conduit 3 comprises a receptacle 31 for a mixing cartridge, a connecting piece 32 or a hose and a connecting piece 33 for a rinsing shower, a foamer or the like.

The projections 14, 15, 24, 25, 26 are provided in the region of the housing body as well as in the region of the outlet, so that the functional unit 3 after the joining of the single parts 1, 2 is fixed firmly in the fixture body. The water conduit 3 thus forms an independent and watertight unit so that the drinking water does not have any contact with the housing body. The housing body has merely a stabilizing and decorative function. Due to the many possibilities with respect to the arrangement of separation joints, different geometries and designs can be realized for the housing body and the outlet.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for producing a sanitary fixture, the method comprising:

producing at least two shell-shaped single parts with profiled joint edges for a housing body via a die-casting method;

inserting a functional unit that includes all water-carrying parts of the sanitary fixture into one of the single parts of the housing body; and producing the housing body by joining the shell-shaped single parts via an adhesive or material bonding joining process, wherein the profiled joint edges of each shell-shaped single part include a projection on a first joint edge and a recess on a second joint edge, such that during the joining of the shell-shaped single parts, the projection of a first shell-shaped single part engages in the recess of a second shell-shaped single part and the projection of the second shell-shaped single part engages in the recess of the first shell-shaped single part.

2. The method for producing a sanitary fixture according to claim 1, wherein, before the production of the housing body, a coating of the single parts is carried out via wet-chemical methods, physical methods or painting methods or a combination of layers according to these methods.

3. The method for producing a sanitary fixture according to claim 1, wherein, before the production of the housing body, a preparation of the joint edges of the single parts is carried out by mechanical or chemical roughening or is activated by atmospheric plasma on an atomic level.

4. The method for producing a sanitary fixture according to claim 1, wherein the material bonding joining process is a welding process, and wherein, after the joining of the single parts via adhesion or welding, a reworking of the adhesive joint or the weld seam is carried out by grinding, brushing or polishing.

5. The method for producing a sanitary fixture according to claim 1, wherein a coating of the housing body takes place, via which separation joints between the single parts are covered such that the housing body appears to be of one piece.

6. The method for producing a sanitary fixture according to claim 5, wherein the coating includes applying a layer sequence of a primer paint coat, a PVD layer and a paint cover layer.

7. The method for producing a sanitary fixture according to claim 1, wherein when the first shell-shaped single part is joined to the second shell-shaped single part, the projection of the first shell-shaped single part forms part of an inner surface of the housing body and the projection of the second-shell-shaped single part forms part of an outer surface of the housing body, and wherein a length of the projection of the first shell-shaped single part is smaller than a length of the projection of the second shell-shaped single part, such that during joining, a gap between a distal end of the projection of the first shell-shaped single part and a bottom of the recess of the second shell-shaped single part is provided.

* * * * *